US006761612B1

(12) United States Patent
Pencil et al.

(10) Patent No.: US 6,761,612 B1
(45) Date of Patent: Jul. 13, 2004

(54) DIGITAL SPORTS POP-UP

(75) Inventors: Brad A. Pencil, Lake In The Hills, IL (US); James A. Leopardo, North Barrington, IL (US)

(73) Assignee: Out Of The Box, Hoffman Estates, IL (US)

( * ) Notice: Subject to any disclaimer, the term of this patent is extended or adjusted under 35 U.S.C. 154(b) by 0 days.

(21) Appl. No.: 10/428,236

(22) Filed: May 2, 2003

(51) Int. Cl.[7] ..... A63H 13/16

(52) U.S. Cl. ..... 446/310; 446/76; 446/308; 446/330; 40/411; 473/570

(58) Field of Search ..... 446/72, 73, 76, 446/81, 175, 308–311, 330, 352, 475; 40/411, 221, 224, 124.08, 124.03, 124.06; 473/594, 570; 273/156, 157 R

(56) References Cited

U.S. PATENT DOCUMENTS 847,715 A * 3/1907 Wood ..... 446/310
3,037,779 A * 6/1962 Duncan ..... 446/299
3,667,155 A * 6/1972 Freelander ..... 446/310
4,453,340 A * 6/1984 Kozuka et al. ..... 446/437
6,262,352 B1 * 7/2001 Liu ..... 84/95.2
6,468,126 B1 * 10/2002 Herber ..... 446/310
6,536,145 B2 * 3/2003 Burth ..... 40/124.08

* cited by examiner

*Primary Examiner*—Derris H. Banks
*Assistant Examiner*—Bena B. Miller
(74) *Attorney, Agent, or Firm*—Leydig, Voit & Mayer, Ltd.

(57) ABSTRACT

A digital sports pop-up apparatus in which the apparatus is representative of a predetermined sport. The apparatus comprises a stand member with a substantially hollow member engageable with an upper portion of the stand member, the substantially hollow member being in a predetermined shape indicative of a particular sport. There is an opening disposed adjacent a top of the hollow member to enable access into an interior thereof. A pop-up figure is disposed within the interior of the hollow member. A hinged lid is rotatingly engageable with the hollow member adjacent the opening for closing the opening. A latch is disposed in one of the hollow member and the hinged lid for securing the hinged lid in a closed position. There is a means engageable with the latch means for releasing the lid and a biasing means for causing the pop-up figure to be raised out of the hollow member when the hinged lid is open.

14 Claims, 2 Drawing Sheets

DIGITAL SPORTS POP-UP

FIELD OF THE INVENTION

The present invention relates, in general, to a novelty pop-up apparatus, and, more specifically, the present invention relates to a sports pop-up apparatus having a speaker.

BACKGROUND OF THE INVENTION

There are myriad of novelty items on the market today. Many of these novelty items pertain to sports or to the entertainment field. It is such a fast growing industry since there are so many more teams that are available in the market today and there is growth in various sports that previously were not popular.

Thus, a novelty apparatus that relates to a particular professional team or to a particular college can find its niche among the fans of the those teams.

SUMMARY OF THE INVENTION

The present invention provides a digital sports pop-up apparatus in which the apparatus is representative of a predetermined sport. The apparatus comprises a stand member with a substantially hollow member engageable with an upper portion of the stand member, the substantially hollow member having a predetermined shape indicative of a particular sport. There is an opening disposed adjacent a top of the substantially hollow member to enable access into an interior thereof. A pop-up figure is disposed within the interior of the substantially hollow member. A hinged lid is rotatingly engageable with the substantially hollow member adjacent the opening for closing the opening.

A latch is disposed in one of the substantially hollow member and the hinged lid for securing the hinged lid in a closed position. There is a mechanism engageable with the latch for releasing the lid and a biasing means for causing the pop-up figure to be raised out of the substantially hollow member when the hinged lid is open. There is, further, an activation mechanism which causes the release of the hinged lid, thereby causing the pop-up figure to be raised out of the substantially hollow member.

OBJECTS OF THE INVENTION

It is one of the primary objects of the present invention is to provide a digital sports pop-up apparatus which contains a speaker.

Another object of the present invention is to provide a digital sports pop-up apparatus in which the basic unit is in the shape of a ball used in various sports such as a basketball or a football.

Still another object of the present invention is to provide a digital sports pop-up apparatus in which the basic unit is decorated to represent a specific team.

Yet another object of the present invention is to provide a digital sports pop-up apparatus in which the pop-up member is decorated so as to coordinate with the logo decorating the basic unit.

An additional object of the present invention is to provide a digital sports pop-up in which a speaker can play a melody related to the designated team on the basic unit.

Yet another object of the present invention is to provide a digital sports pop-up apparatus in which the speaker can be programmed to play a selection designated or recorded by the user.

These and various other objects and advantages of this invention will become apparent after a full reading of the following detailed description, particularly when read in conjunction with the attached drawings as described below and the appended claims.

Figure 1:
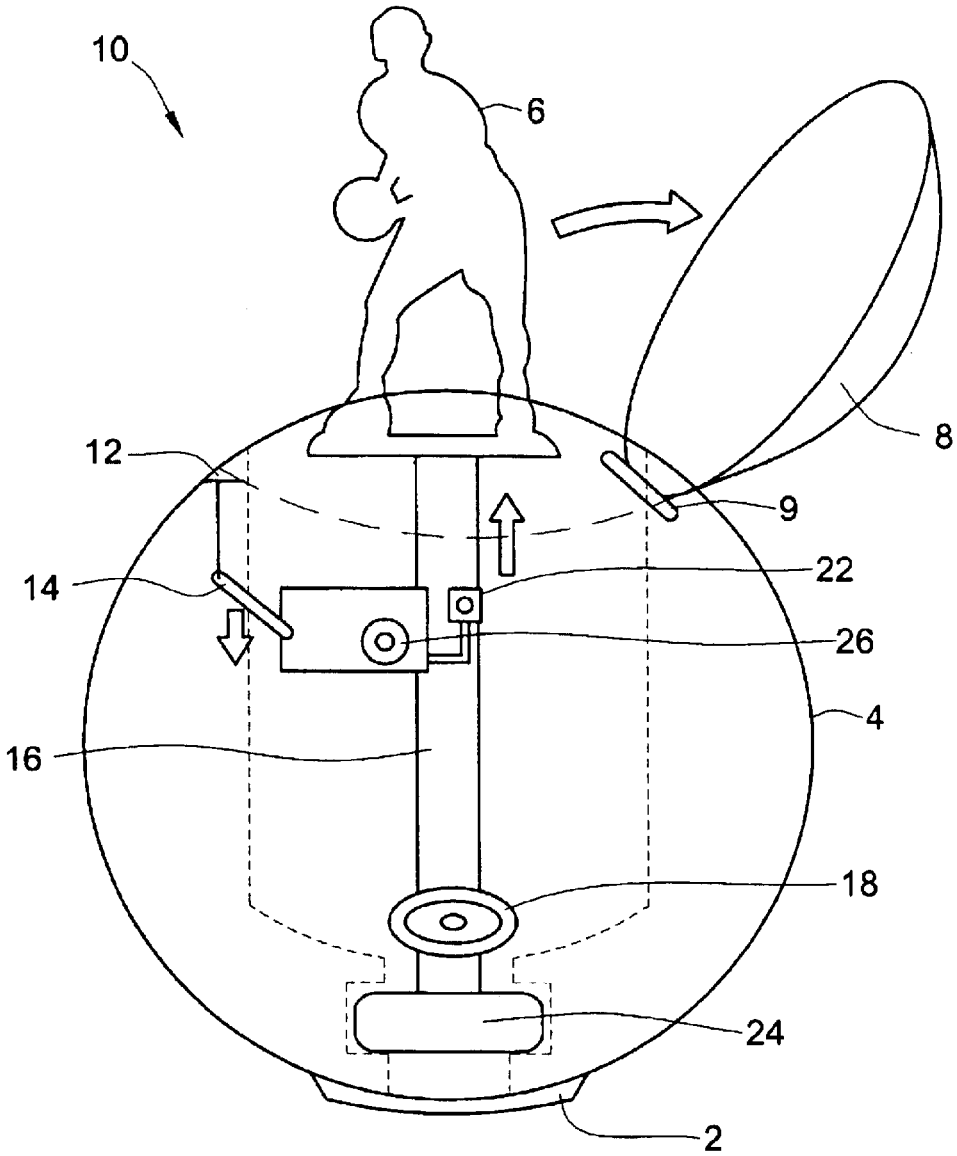
FIG. 1 is a cross sectional view of one embodiment of the invention wherein the basic unit is in the shape of a basketball.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Illustrated in FIG. 1 is a cross sectional view of a digital sports pop-up apparatus, generally designated 10. In FIG. 1 the sports pop-up is displayed as a basketball figure emerging from a basketball. However, the apparatus would also be applicable for a sports figure to emerge from a football, soccer ball, baseball, golf ball, tennis ball, bowling ball, and could also be applicable to a hockey puck.

The digital sports pop-up apparatus 10 comprises a stand member 2. Such stand member 2 is the base of the unit permitting such apparatus 10 to sit on a flat surface. A substantially hollow member 4 is engageable with an upper portion of stand member 2. The substantially hollow member 2 has a predetermined shape that is indicative of a sport. In FIG. 1 the predetermined shape is that of a basketball; however, as mentioned previously, the shape could be that of balls or equipment related to various sports.

Figure 2:
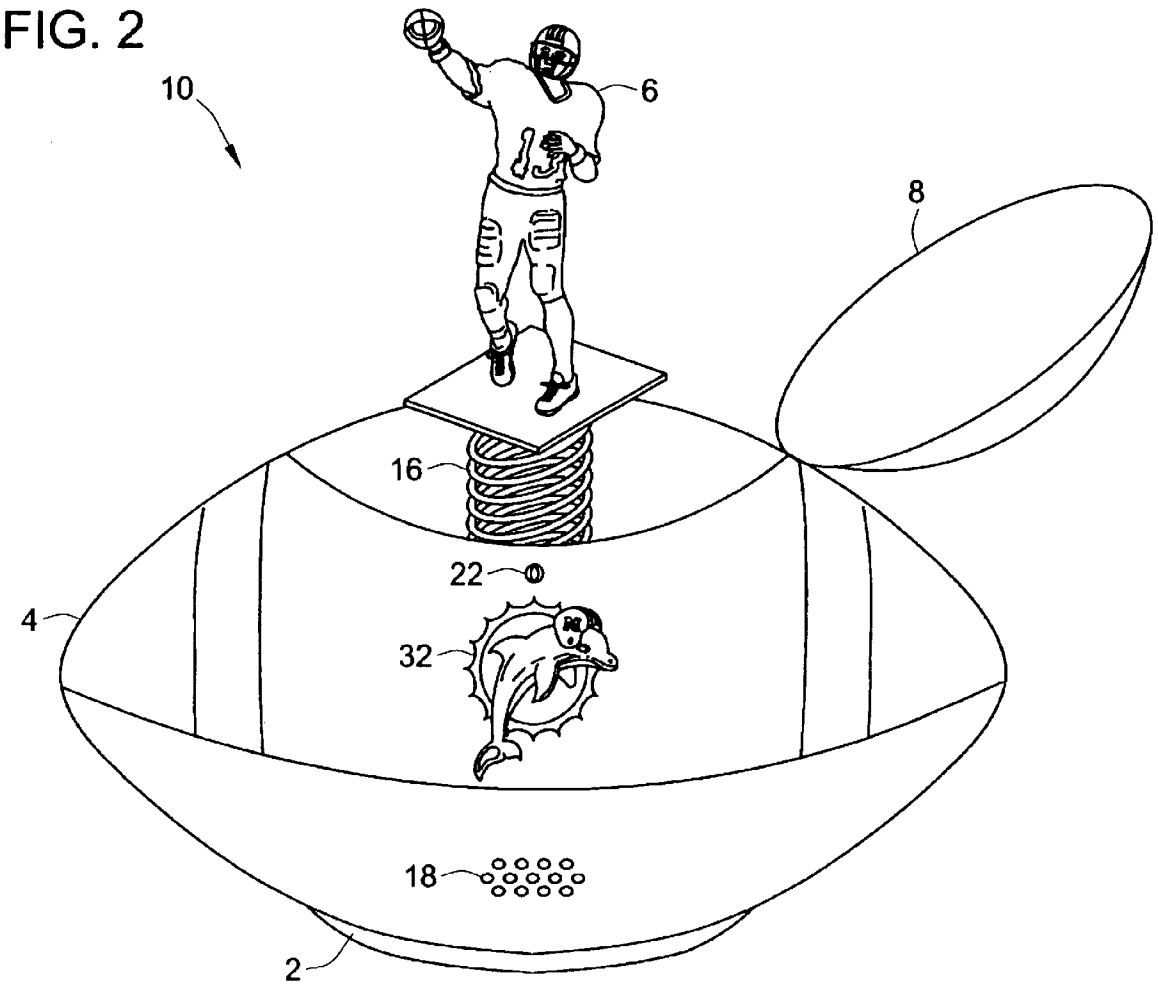
FIG. 2 is a frontal view of an embodiment of the invention in which the basic unit is in the shape of a football.

A pop-up figure 6 is disposed within such hollow member 4. As is evident the sport pop-up figure 6 is designed to correlate with the substantially hollow member 4. So as seen in FIG. 1 the pop-up figure 6 is in the shape of a basketball player holding a basketball emerging from substantially hollow member 4 which is in the shape of a basketball. As a corollary, if the substantially hollow member 4 was in the shape of a football, the pop-up figure 6 would be a football player with a football. This is evident in FIG. 2. Also, as seen in FIG. 2, the substantially hollow member 4 in the shape of a football has a place for a logo 32 of a particular team and the pop-up figure 6 is dressed in a uniform corresponding to the team logo 32 is seen on the exterior of the hollow member 4.

There is an opening disposed adjacent a top of the substantially hollow member 4 to enable access into an interior thereof and a hinged lid 8 that is rotatingly engageable with the substantially hollow member 4 adjacent the opening for closing such opening.

A latch 12 is disposed in one of the substantially hollow member 4 and the hinged lid 8 for securing the hinged lid 8 in a closed position. A biasing means 9, substantially a spring 9, is connected to one end of the hinged lid 8 to cause the lid to rotate open when the lid 8 is released. It is presently preferred that such latch 12 be disposed in the substantially hollow member 4. In this case the latch 12 is engageable with the hinged lid 8 to hold the hinged lid 8 in a closed position until the latch 12 is released.

A releasing means 14 is disposed within the substantially hollow member 4 and is engageable with the latch 12. Such releasing means 14 is preferably a mechanical lever so that when the unit is activated such (mechanical lever) releasing means 14 pulls on and releases latch 12, permitting the hinged lid 8 to rotate because of biasing means 9 to the open position.

There is another biasing means 16 that is engageable with the pop-up figure 6 so that when the unit is activated and the hinged lid 8 is released the biasing means 16 causes the pop-up figure 6 to be raised to a position where such pop-up figure 6 is at least partially outside of the hollow member 4. It is presently preferred that such biasing means 16 is a spring.

In an alternate embodiment of the invention such digital sports pop-up apparatus 10 further includes a standard speaker means 18 for producing an audible sound which is disposed within the substantially hollow member 4. The speaker means 18 thus includes a standard sound reproduction device, which may be prerecorded to play a cheer or a fight song or other such song related to the pop-up figure 6 and the hollow member 4. In another embodiment of the invention the speaker means 18 may include a standard programmable sound reproduction system that can be programmed to record and reproduce a saying, song or cheer as selected by the user.

It is within the embodiment of the invention that such hollow member 4 be decorated with the logo 32 of a professional or college team and that the sports pop-up figure 6 be dressed in a uniform corresponding to the logo 32 on the hollow member 4. The pop-up figure 6 would also have a number displayed on the uniform that would correspond to a player for that team. This is evident in FIG. 2.

The apparatus 10 further includes a battery 26 for providing the electrical power for the unit to operate. In a presently preferred embodiment of the invention such a battery 26 is a silver oxide cell battery.

The present invention also includes an activation means comprising a button 22 for activating and energizing the unit. Thus, when the button 22 is pushed, or otherwise moved, then the mechanical lever 14 releases the latch 12 which permits the spring 9 to force hinged lid 8 to an open position and biasing means 16 causes the pop-up figure 6 to be raised out of the substantially hollow member 4. At the same time the speaker means 18 is energized and a song or cheer is played.

The substantially hollow member 4 also includes a weighted base member 24 that is disposed closely adjacent to the bottom of such substantially hollow member 4 to provide weight for the apparatus so as to prevent or reduce the likelihood of the unit being tipped over accidentally.

The basic unit could be equipped to portray any college team, football, basketball or whatever, with the color of the unit and the logos 32 along with the pop-up figure 6 decorated so as to coordinate with the team depicted on the exterior surface of the hollow member 4. The unit could also portray any professional team, again showing the colors and logos of that team.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

We claim:

1. A digital sports pop-up apparatus in which said apparatus is representative of a predetermined sport, said apparatus comprising:

(a) a stand member;

(b) a substantially hollow member engageable with an upper portion of said stand member, said substantially hollow member being in a predetermined shape indicative of said predetermined sport and having an exterior surface;

(c) an opening disposed adjacent a top of said substantially hollow member to enable access into an interior thereof;

(d) a pop-up figure disposed within said interior of said substantially hollow member;

(e) a hinged lid rotatingly engageable with said substantially hollow member adjacent said opening for closing said opening;

(f) a latch disposed in one of said substantially hollow member and said hinged lid for securing said hinged lid in a closed position;

(g) a releasing means engageable with said latch means for releasing said latch;

(h) a biasing means for causing said pop-up figure to be raised out of said substantially hollow member when said hinged lid is open;

(i) an activation means for activating said means for releasing said hinged lid; and (i) a weighted member disposed adjacent a lower portion of said substantially hollow member to provide stability for said apparatus.

2. The digital sports pop-up apparatus, according to claim 1, wherein said latch is disposed in said substantially hollow member.

3. The digital sports pop-up apparatus, according to claim 1, wherein said means for releasing said lid is disposed in said substantially hollow member.

4. The digital sports pop-up apparatus, according to claim 1, wherein said predetermined shape of said substantially hollow member is one of a football, basketball, baseball, soccer ball, golf ball, tennis ball, bowling ball and a hockey puck.

5. The digital sports pop-up apparatus, according to claim 4, wherein an exterior surface of said substantially hollow member is decorated with a logo that is indicative of a sports team that is representative of said predetermined shape.

6. The digital sports pop-up apparatus, according to claim 5, wherein said pop-up figure is decorated so as to coordinate with such sports team depicted on said exterior surface of said substantially hollow member.

7. The digital sports pop-up apparatus, according to claim 6, wherein said apparatus further includes a speaker means for producing an audible sound.

8. The digital sports pop-up apparatus, according to claim 1, wherein said hinged lid is spring mounted.

9. The digital sports pop-up apparatus, according to claim I, wherein said biasing means is a spring.

10. The digital sports pop-up apparatus, according to claim 1, wherein said means for releasing said lid includes a mechanical lever which releases said latch means and permits said hinged lid to rotate to an open position.

11. The digital sports pop-up apparatus, according to claim 1, wherein said button protrudes out of said exterior surface of said substantially hollow member.

12. The digital sports pop-up apparatus, according to claim 1, wherein said apparatus further includes a speaker means for producing an audible sound.

13. The digital sports pop-up apparatus, according to claim 12, wherein said speaker means is disposed within said substantially hollow member.

14. The digital sports pop-up apparatus, according to claim 12, wherein said speaker means is prerecorded to play a cheer, a fight song and other songs related to said figure and can record a saying, song and cheer as selected by the user.

* * * * *